US008555669B1

(12) United States Patent
LeBlanc et al.

(10) Patent No.: US 8,555,669 B1
(45) Date of Patent: Oct. 15, 2013

(54) AIR CONDITIONER CONDENSING UNIT FOR CORROSIVE ENVIRONMENTS

(75) Inventors: Mervyn LeBlanc, Houma, LA (US); David Sandlin, Houma, LA (US); Scott Berniard, Houma, LA (US)

(73) Assignee: LeBlanc & Associates, Inc, Houma, LA (US)

( * ) Notice: Subject to any disclaimer, the term of this patent is extended or adjusted under 35 U.S.C. 154(b) by 882 days.

(21) Appl. No.: 12/589,001

(22) Filed: Oct. 16, 2009

Related U.S. Application Data

(60) Provisional application No. 61/197,207, filed on Oct. 24, 2008.

(51) Int. Cl.
*F25D 17/06* (2006.01)

(52) U.S. Cl.
USPC ..... 62/428; 62/498

(58) Field of Classification Search
USPC ..... 62/428, 240, 285, 503, 426, 498
See application file for complete search history.

(56) References Cited

U.S. PATENT DOCUMENTS 4,671,825 A * 6/1987 Ishii et al. ..... 148/251
5,848,536 A * 12/1998 Dodge et al. ..... 62/240
5,967,748 A * 10/1999 Jang ..... 415/211.1
6,101,823 A 8/2000 Chiu
6,318,104 B1 11/2001 Moraes
6,591,627 B1 7/2003 Rollins
7,210,305 B2 * 5/2007 Shin ..... 62/285
7,278,272 B2 * 10/2007 Huston et al. ..... 62/78
2006/0168995 A1 * 8/2006 Fralick et al. ..... 62/503

OTHER PUBLICATIONS

Mermaid Marine Air Conditioner, Control Masters Inc, Feb. 3, 2007—Solid Stainless Steel Baseplate.*
E-Coating Helps Improve Coil Performance, ElectroFin, Sep. 2, 2004, Paragraph 11—epoxy coating one mil thick.*
Non-Metallic NEMA 4X Enclosures, Automation Direct, Mar. 25, 2007, Corrosive Environment applications, Water tight.*
Corrosion Grenade, Nov. 8, 2006, Paragraph 2—Dramatically slow corrosion of all nearby metal parts.*
British Stainless Steel Association, Making the Most of Stainless Steel, Oct. 19, 2007, paragraph 1-316 widely used in marine applications.*

* cited by examiner

*Primary Examiner* — Mohammad M Ali
(74) *Attorney, Agent, or Firm* — Henry E. Naylor

(57) ABSTRACT

An improved air conditioner condensing unit for use in corrosive environments. The condensing unit comprises a compressor, a condenser coil containing cooling fins having a spacing of about 0.080 to about 0.050 inches, and a motorized corrosive resistant shrouded fan assembly, all of which are mounted on a substantially flat corrosive resistant baseplate.

9 Claims, 3 Drawing Sheets

AIR CONDITIONER CONDENSING UNIT FOR CORROSIVE ENVIRONMENTS

This application is based on Provisional Application 61/197,207 filed Oct. 24, 2008.

FIELD OF THE INVENTION

The present invention relates to an improved air conditioner condensing unit for use in corrosive environments. The condensing unit comprises a compressor, a condenser coil containing cooling fins having a spacing from about 0.080 to about 0.050 inches, and a motorized corrosive resistant shrouded fan assembly, all of which are mounted on a substantially flat corrosive resistant baseplate.

BACKGROUND OF THE INVENTION

Corrosive environments present a significant problem for equipment such as air conditioning equipment. One such corrosive environment is a marine environment. Marine air conditioning equipment must withstand significantly harsher environments when compared to air conditioning equipment designed and used in non-corrosive environments. For example, one problem associated with air conditioning equipment used on boats, such as offshore supply boats and crew boats serving the oil industry, is rapid deterioration of the condenser coil. It is common that the fins of conventional condenser coils become plugged owing to such things as salt corrosion, chemical dust resulting from the transportation of various chemical cargoes, as well as other extraneous particulate matter. Salt water corrosion significantly shortens the service life of the marine equipment.

There is a wide variety of marine air conditioning equipment on the commercial market, but they all are all faced with premature failure owing to the above mentioned problems. Several approaches have been taken to improve marine air conditioning equipment. For example, U.S. Pat. No. 5,848,536 teaches a self contained marine air conditioner whose operative components are mounted in a deep condensate pan with the condenser coil within the same shroud as the evaporator coil and between the evaporator coil and the blower. A decontamination system for a marine air conditioner is taught in U.S. Pat. No. 7,278,272 wherein a germicidal lamp, which preferably emits ultraviolet radiation is provided upstream of the evaporator coil.

While there are various commercial marine air conditioning units on the market today they all suffer from premature failure due to harsh corrosive environments. Therefore, there is a need in the art for air conditioner equipment that can better withstand harsh corrosive environments compared to conventional air conditioner equipment on the market today.

SUMMARY OF THE INVENTION

In accordance with the present invention, there is provided a condensing unit for use with an air conditioning system, which condensing unit is comprised of:

a) a substantially flat and substantially corrosion resistant baseplate having a first end and a second end and containing at least one drain hole;

b) a condenser coil assembly coated with a corrosion resistant material and operatively secured to said first end of said baseplate;

c) a fan including a fan blade and a motor for rotating said fan blade, which fan is secured to said second end of said baseplate, wherein the fan blade is oriented so that a stream of air is drawn through said condenser coil assembly;

d) a shroud positioned around said fan blade;

e) a compressor operatively connected to said condenser coil and positioned between said fan and said condenser coil, which compressor is capable of compressing and moving a refrigerant through the condenser coil; and f) a corrosive resistant water tight electrical enclosure wherein the main power, controller connections, and electrical components of said condensing unit are connected.

In a preferred embodiment the baseplate is comprised of stainless steel

In another preferred embodiment there is also present a sacrificial anode on a line leading to or leading from the compressor.

DETAILED DESCRIPTION OF THE INVENTION

The condensing unit of the present invention is suitable for use as a component of an air conditioning system used on a stationary or mobile structure in a corrosive environment, preferably a marine environment. By "marine environment" we mean on or about a body of water, preferably salt water, such as seas and oceans. Non-limiting examples of preferred stationary structures on which the condensing unit of the present invention can be used include industrial plants and petroleum drilling and production platforms. Non-limiting examples of preferred mobile structures on which the condensing unit of the present invention can be used include boats and ships, preferably those used to transport personnel and supplies to offshore drilling and production platforms. Pleasure boats and cruise ships are also examples of mobile marine structures on which the condensing unit of the present invention can be used.

As previously mentioned, it is notoriously known that a marine environment is a harsh environment with respect to a wide variety of equipment, particularly equipment that contains components that are subject to corrosion in a salt water environment. The condensing unit of the present invention, which is used as part of a marine air conditioning system, overcomes many of the shortcomings of conventional marine air conditioning systems. For example, the condensing unit of the present invention is substantially more corrosion resistant compared to conventional marine condensing units. It is also substantially more resistant to plugging and fouling.

Figure 1:
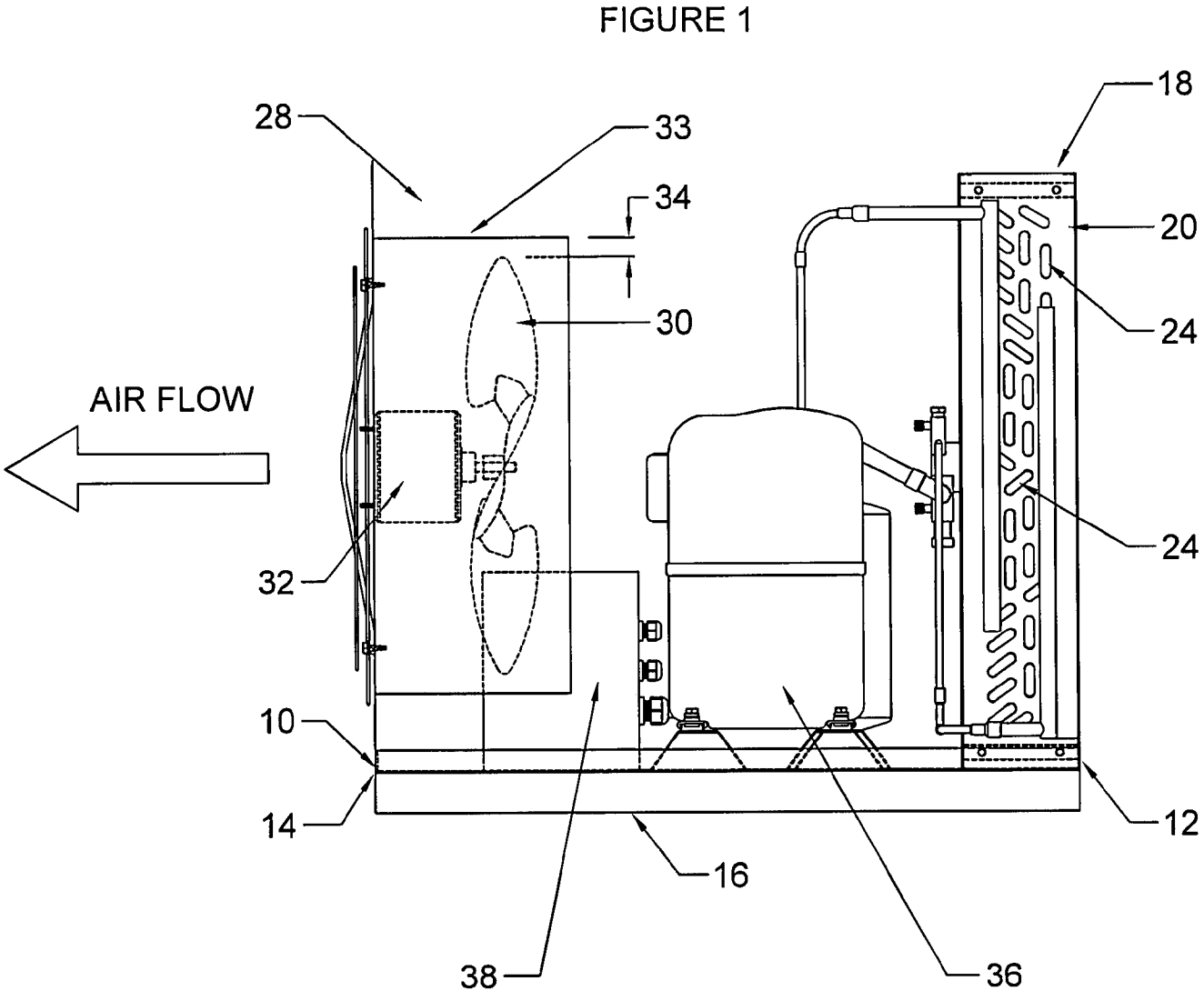
FIG. 1 hereof is a side view showing the main components of the condensing unit of the present invention.

The present invention will be better understood with reference to the figures hereof. FIG. 1 hereof is a representation of a side view of the condensing unit of the present invention. The condensing unit is comprised of a base plate 10 which can be of any suitable substantially flat geometric shape. It is preferred that it be rectangular in shape, having a first end 12 and a second end 14 with two opposing sides. Conventional condensing units typically have their components mounted to a baseplate that has been pressed from a single sheet of metal that serves to strengthen the base. During the pressing process, mounting locations for the various condensing unit components are also pressed into the base, thereby leaving indentations in the base which often act as water reservoirs. These reservoirs have a tendency to also retain corrosive material such as salt and other corrosive chemicals, which leads to deterioration and premature failure of the base plate as well as being a hazard for personnel. The base plate of the condensing unit of the present invention is substantially flat and contains no such indentations. Holes are drilled, or punched, through the base plates of the present invention to allow drainage of liquids and to provide places where the various components are secured to the base plate. It is preferred that the base plates of the present invention be made of a corrosion resistant material such as carbon fiber reinforced polymeric materials and stainless steels. Stainless steels are preferred with 316 grade stainless steel being more preferred. 316 grade stainless steel typically contains from about 16 wt. % to 18 wt. % chromium. It is also preferred that all mounting hardware, such as screws, nuts and bolts also be made of a corrosive resistant material, preferably a stainless steel.

The base plates of the present invention are preferably reinforced by use of a plurality, preferably three, runners 16 which run from the front to the back of said base plate. Runners 16 are of a predetermined height of from about 0.5 to 2 inches to raise to the condensing unit above a lower stacked condensing unit or mounting foundation to allow any water can drain.

Figure 2:
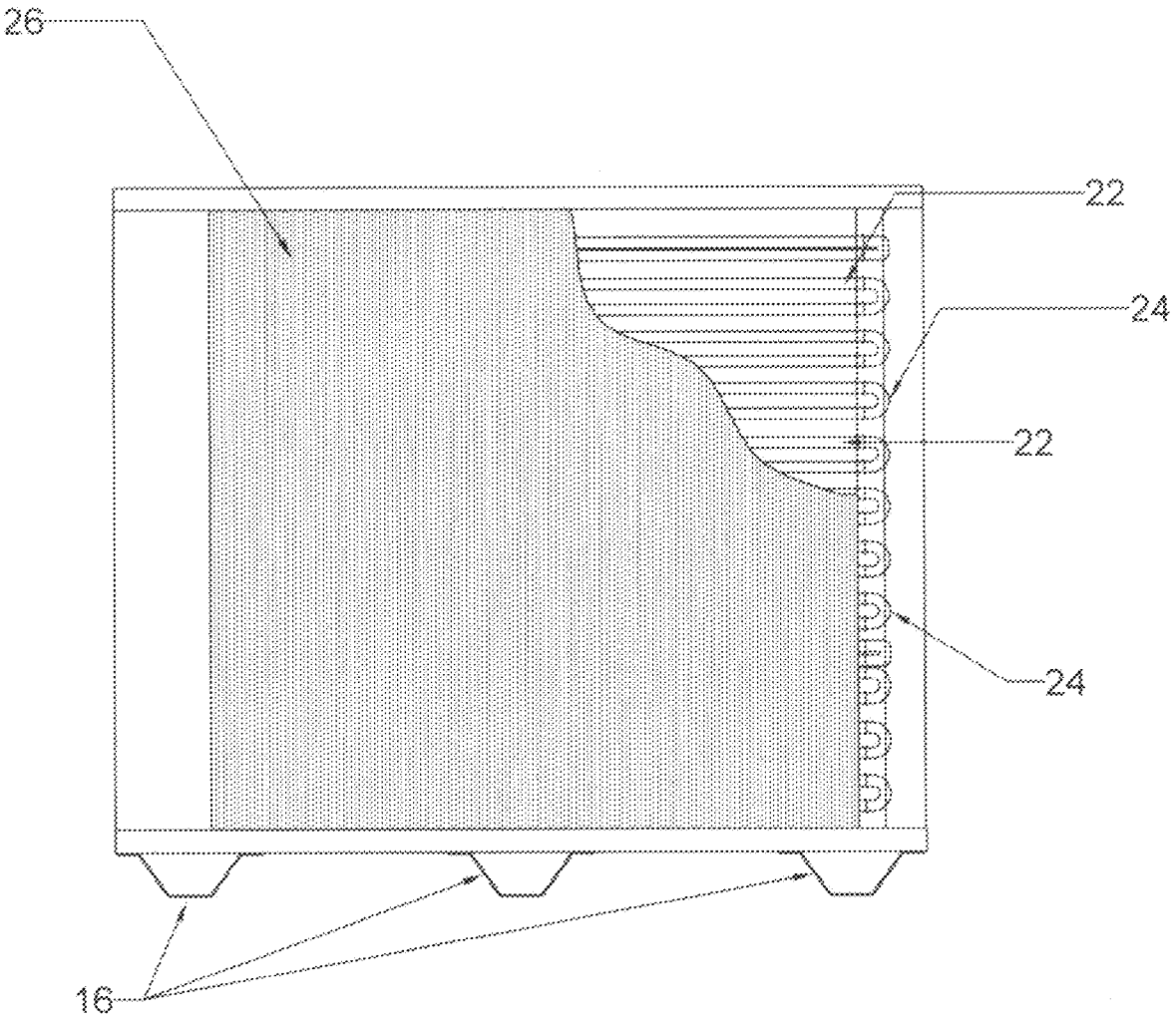
FIG. 2 hereof is a front view of the condensing unit of the present invention showing condenser coils, heat transfer fins, and runners.

The condensing unit of the present invention contains a condenser coil assembly 18 which is vertically disposed and secured at said first end 12 of said base plate 10. Condenser coil assemblies are well known in the art and are typically comprised of two opposing header plates 20, which are also sometimes referred to as tube sheets, through which refrigerant carrying tubes, or coils (22 of FIG. 2), extend across the width of the condenser coil assembly. The ends of the tubes are interconnected by return bends 24 so that a continuous loop, of a serpentine shape, forms the condenser coil. There is a predetermined spacing between each horizontally disposed coil section. A large number of vertically disposed closely spaced fins 26, typically formed of a thin metallic material such as aluminum, are penetrated by the coil tubes to assist in heat transfer.

The number of fins per square inch of conventional condensing units is typically from about 20 to 25 fins per inch. In a hostile environment, such as in a marine environment, particularly on crew and supply boat, such a spacing leads to plugging from anything from salt spray to particulate matter. This in turn leads to premature compressor failure and increased maintenance cost. The number of fins per square inch for the condensing units of the present invention is from about 12 to 18 fins per inch, preferably from about 14 to 16 per inch. These fins per inch correspond to a spacing of about 0.080 to about 0.050 inches preferably from about 0.070 to about 0.060 inches. Of course a balance must be struck between the surface area needed to provide adequate heat transfer and the distance between fins needed to prevent significant premature clogging of the fins.

The corrosion resistance of the condenser coil assembly of the present invention is improved by coating the entire assembly (coil, fins, and refrigerant inlet and outlet manifolds) with a suitable corrosion inhibitor. It if preferred that the assembly be coated by a dipping method wherein the entire assembly is dipped into a bath of suitable corrosion inhibitor. It is also preferred that the coated surface be substantially hydrophilic to mitigate bridging between fins, which is typically caused by the condensation of water droplets on the surface of the fins. One method that can be used to create a hydrophilic coated surface is described in U.S. Pat. No. 4,671,825 which incorporated herein by reference. This '825 patent discloses a method for forming a hydrophilic corrosion-resistant coating on the surface of a metallic material, which method comprises preparatorily cleaning the surface of the metallic material. The cleaned surface is treated with an aqueous treating liquid produced by adding a water-soluble acrylic acid polymer and colloidal silica and selected amounts of polyhydric alcohols and/or saccharides to an aqueous solution containing hexavalent chromium compound or trivalent and hexavalent chromium compounds, phosphoric acid, and a fluorine compound. The treated surfaces are dried of the treating liquid, then baked at a baking temperature in the range of about 100° to about 250° C. A more preferred corrosive resistant coating is one provided by ElectrFin Inc. having offices in Louisiville, Ky. wherein a flexible epoxy coating is substantially uniformly applied to all coil surface areas without material bridging between fins. This coating process ensures substantially complete coil capsulation and a substantially uniform dry film thickness from about 0.8 to about 1.2 mil thick on all surfaces including fin edges.

The condensing unit of the present invention will also contain a Fan 28 that includes a fan blade 30 and a motor 32 for rotating the fan blade 30. The fan is secured at said second end 14 of said baseplate 10. The fan blade 30 is oriented so that during operation a stream of air is drawn through said condenser coil assembly 18. A corrosive resistant shroud 33 is provided about the fan blade 30 so that there is an effective gap 34 between the edge of the blower blades and the shroud. This gap will be from about 0.125 inch to about 0.875 inch, preferably from about 0.125 inch to about 0.625 inch. Conventional condensing units typically vertically discharge air that is passed through a condenser coil assembly. Discharging air vertically within the confines of another deck would cause the heated condensing air to be re-circulated and drawn back into the condenser coils, causing the unit to operate at an undesirable high temperature and pressure. This would lead to diminished capacity of the condensing unit. Also, vertical discharge would require more space when multiple units are required because they would have to be placed side-by-side and a certain minimum distance needs to be provided between units to allow for service and adequate air flow. The condensing unit of the present invention discharges air horizontally so that multiple condensing units can be stacked on one another to conserve valuable space. Also, the condensing unit of the present invention is enclosed with corrosive resistant panels, such as stainless steel panels of an effective strength to that at least two additional condensing units can be stacked thereon.

The condensing unit of the present invention also contains a compressor 36 suitable for compressing a refrigerant. The compression of the refrigerant results in refrigerant being heated. The heated refrigerant is then sent through the condenser coils where a substantial amount of heat is dissipated through the fins. The compressor can be any type of compressor of suitable size for the overall air conditioning system and can be of the reciprocating piston type, the scroll type or any other type suitable for compressing a refrigerant used in an air conditioning system.

A water tight electrical enclosure 38 is also provided wherein electrical leads such as the electrical leads 40 which provide power to electrical components of the condensing unit such as the fan 28 and compressor 36. Electrical connections are also provided for a controller and main (field) power within the electrical enclosure. It is preferred that the electrical enclosure be comprised of a corrosion resistant material such as a polymeric composite material or stainless steel.

Figure 3:
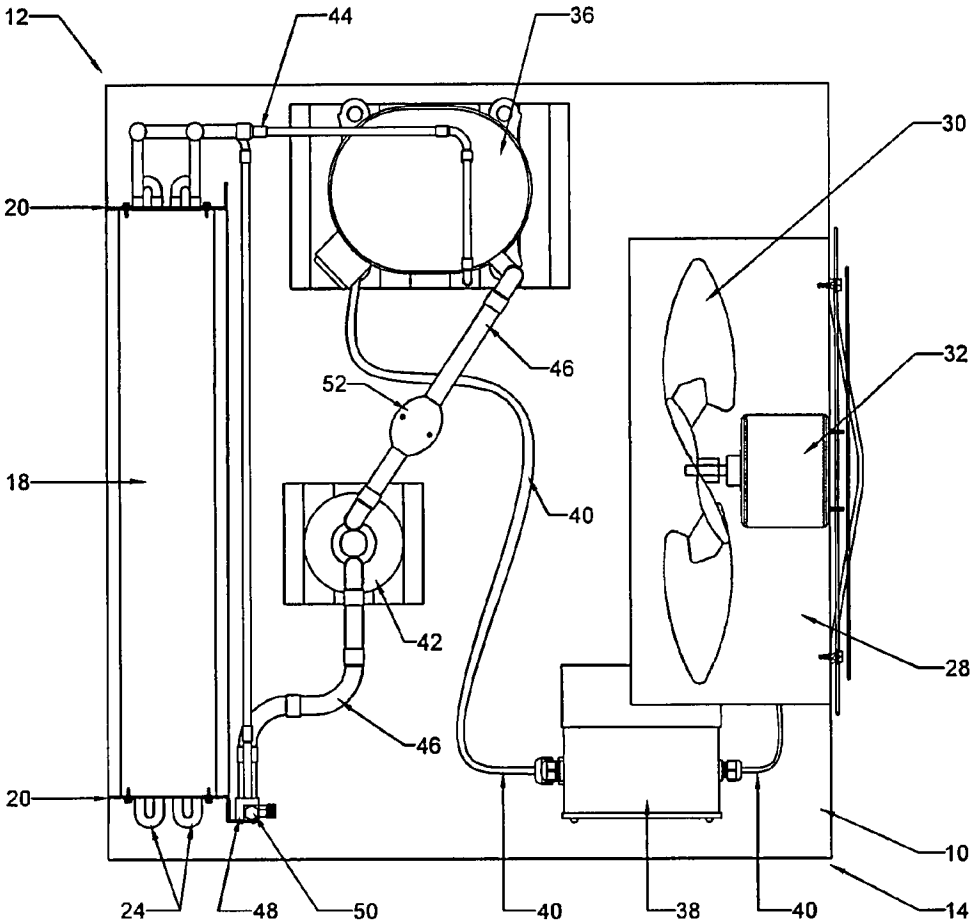
FIG. 3 is a top view of the condensing unit of the present invention.

FIG. 3 hereof is a top view of the air condensing unit of FIG. 1 hereof. The condensing unit of the present invention is designed to be used in a closed loop air conditioning system.

Closed-loop air conditioning systems conventionally employ a compressor that draws in gaseous refrigerant at relatively low pressure and discharges hot refrigerant at relatively high pressure. The hot refrigerant condenses into liquid as it is cooled in the condenser. A small orifice or valve divides the system into high-pressure and low-pressure sides. The liquid on the high-pressure side passes through the orifice or valve and turns into a gas in the evaporator (not shown) as it picks up heat. At low heat loads it is not desirable or possible to evaporate all the liquid. However, liquid refrigerant entering the compressor (known as "slugging" or "carryover") causes system efficiency loss and can cause damage to the compressor. Hence an accumulator (suction accumulator) 42 is provided between the evaporator and the compressor to separate and store the excess liquid. The suction accumulator 42 is typically a metal can, welded together, and often has fittings attached for a switch and/or charge port. One or more inlet tubes and an outlet tube pierce the top, sides, or occasionally the bottom, or attach to fittings provided for that purpose. The refrigerant flowing into a typical accumulator will impinge upon a deflector or baffle intended to reduce the likelihood of liquid flowing out the exit. FIG. 3 also shows high pressure line 44 which passes hot refrigerant gas to the condenser coil 18. There is also shown low pressure lines 46 that receives refrigerant from one or more evaporators (not shown) which pass though the suction accumulator 42 to compressor 36. Also shown is a suction service valve 48 and liquid service valve 50, both of which are well known in the refrigeration and air conditioning art. Also shown in sacrificial anode 52.

It is also within the scope of this invention that a sacrificial anode be used at one or more locations on the condensing unit of the present invention. A preferred location would be to encase a section of the tubing from the compressor to the condenser coil with a sacrificial anode. A sacrificial anode is a metallic anode used in cathodic protection to protect other metals from corrosion. The more active metal corrodes first (hence the term "sacrificial) and generally must oxidize nearly completely before the less active metal (copper tubing) will corrode, thus acting as a barrier against corrosion for the protected metal. One particularly preferred sacrificial anode is the one provided by A/C Zincs, Inc and available under the tradename "The Corrosion Grenade". Such an anode protects against galvanic corrosion that occurs whenever two dissimilar metals, electrical power, and an electrolyte (salt) are present. Aluminum, the softest metal in the condensing unit, begins to deteriorate as soon as the system is started. Use of a sacrificial anode will prolong the life of the condenser coil assembly.

What is claimed is:

1. A condensing unit for use with an air conditioning system, the condensing unit is associated with a marine vessel and is resistant to salt water corrosion, the condensing unit is comprised of:

a) a flat and corrosion resistant baseplate having a first end and a second end and containing at least one drain hole;

b) a condenser coil assembly coated with a material, the material is corrosion resistant with respect to a salt water environment and operatively secured to said first end of said baseplate, the condenser coil assembly is comprised of opposing header plates and through the header plates refrigerant carrying tubes extend across the width of said condenser coil assembly and wherein the ends of said tubes are interconnected by return tube bends to form a continuous loop, and wherein there is provided a plurality of horizontally disposed metallic fins penetrated by said tubes wherein the number of fins per inch is about 12 to 18 to mitigate plugging between fins;

c) a fan including a fan blade and a motor for rotating said fan blade, the fan is coated with a material, the material is corrosion resistant to a salt water environment and the fan is secured at said second end of said baseplate, wherein the fan blade and condenser coil assembly are oriented so that a stream of air can be drawn through said condenser coil assembly by operation of said fan and discharged horizontally with respect to a deck of a marine vessel;

d) a corrosion resistant shroud positioned around said fan blade, wherein there is a gap between said fan blade and said shroud, which gap is between about 0.125 inch to 0.875 inch;

e) a compressor operatively connected to said condenser coil and positioned between said fan and said condenser coil, which compressor is capable of compressing and moving a refrigerant through the condenser coil; and f) a corrosive resistant water tight electrical enclosure wherein the main power, controller connections, and electrical components of said condensing unit are connected.

2. The condensing unit of claim 1 wherein the baseplate is comprised of stainless steel.

3. The condensing unit of claim 2 wherein the stainless steel is a 316 grade stainless steel.

4. The condensing unit of claim 1 wherein the coating applied to said condenser coil assembly is from about 0.8 to about 1.2 mils thick.

5. The condensing unit of claim 4 wherein the coating is an epoxy coating.

6. The condensing unit of claim 1 wherein the gap between the shroud and the fan blade is from about 0.125 inch to about 0.625 inch.

7. The condensing unit of claim 1 wherein there is provided a sacrificial anode on the high pressure line between the compressor and the condenser coil assembly, the low pressure line from an evaporator to the compressor, or both.

8. The condensing unit of claim 7 wherein the sacrificial anode is a zinc containing material.

9. The condensing unit of claim 1 wherein there is provided a suction accumulator between evaporator and the compressor.

* * * * *